US005643038A

United States Patent [19]

Olsen et al.

[11] Patent Number: 5,643,038

[45] Date of Patent: Jul. 1, 1997

[54] RECEPTACLE FOR A CONSTRUCTIONAL BUILDING SET

[75] Inventors: Flemming Højberg Olsen, Espergærde; Per Brømsø, Copenhagens, both of Denmark

[73] Assignee: Interlego AG, Baar, Switzerland

[21] Appl. No.: 531,721

[22] Filed: Sep. 21, 1995

[30] Foreign Application Priority Data

Sep. 29, 1994 [DK] Denmark ..... 1126/94

[51] Int. Cl.[6] ..... A63H 33/04

[52] U.S. Cl. ..... 446/75; 446/118; 446/128

[58] Field of Search ..... 446/75, 71, 118, 446/128, 76, 77

[56] References Cited

U.S. PATENT DOCUMENTS 4,513,974 4/1985 Lin ..... 206/579 X
4,872,410 10/1989 Lilly ..... 446/128 X
4,897,066 1/1990 Tapdrup et al. ..... 446/118 X
5,100,324 3/1992 Slayton ..... 206/579 X
5,213,504 5/1993 Lee et al. ..... 446/75 X

*Primary Examiner*—Mickey Yu

*Attorney, Agent, or Firm*—Kane, Dalsimer, Sullivan, Kurucz, Levy, Eisele and Richard, LLP

[57] ABSTRACT

A receptacle for the storage of building elements for a constructional building set is constructed as a trunk having hinged parts. The receptacle is formed with one or more recesses to receive plate-shaped elements incorporated in the constructional building set. Coupling portions in the form of projections are provided along at least a portion of the periphery of the recesses to cooperate with complementary coupling portions in the form of grooves on the plate-shaped elements with a view to establishing temporary retention of the elements.

4 Claims, 3 Drawing Sheets

RECEPTACLE FOR A CONSTRUCTIONAL BUILDING SET

BACKGROUND OF THE INVENTION

The invention concerns a receptacle for the storage of building elements for a constructional building set and constructed as a trunk having hinged parts.

In connection with constructional building sets it is often desirable to construct the receptacles such that these are used not only for sales purposes, but also in connection with the later storage of the building elements of the constructional building set.

It is thus known to construct receptacles as pails in plastics having a removable lid. Examples of such pails are known from U.S. Pat. No. 4,822,314 and U.S. Pat. No. Des. 295,093.

It is known from U.S. Pat. No. 4,872,410 and PCT Patent Application No. WO 93/15809 to manufacture play tables for constructional building sets, in which the building elements are stored in built-in storage compartments.

It is known from the above-mentioned documents to provide a receptacle for the storage of a constructional building set with coupling studs to engage corresponding complementary coupling means of the construction elements. Elements for constructional building sets are usually made of relatively hard plastics materials, which makes them vulnerable to external impacts. The plastics materials used may e.g. be ABS or the like. However, it is not possible to obtain the same good tolerances in the softer plastics materials which are usually employed for receptacles. If these soft plastics materials are nevertheless provided with coupling studs for interconnection with building elements, it will not be possible to obtain a desired coupling force, which means that the impression of the constructional building set in respect of quality is reduced.

SUMMARY OF THE INVENTION

The object of the invention is therefore to provide a receptacle which is capable of containing building elements for a constructional building set, and which can simultaneously be used as a play element, without having the above-mentioned drawbacks.

This object is achieved as stated in the first portion of claim 1, it being hereby possible to make the actual receptacle from an inexpensive and hard-wearing plastics material, such as HDPE or polyethylene, while building elements of hard or brittle materials, such as ABS, are retained in recesses of the actual receptacle on an external side.

When the receptacle is constructed as an integrally hinged trunk, as stated in claim 2, it is possible to mould the receptacle in a simple manner, since it may thus be made by a combination of blow moulding and vacuum forming.

As stated in claim 3, the receptacle in the form of a trunk may be formed with feet in the bottom, ensuring that the receptacle when opened to the open position forms an approximately plane surface in the form of two sides of the trunk. This makes the receptacle extremely useful in connection with play at locations where table or floor surfaces are not accessible. An example of this may be the back seat in a car.

The recesses may advantageously be rectangular, as stated in claim 4, since the opposed end walls of the recess may thus be formed with projections extending into complementary cavities on the construction elements. A plate element may hereby be retained by snap action. The receptacle is further provided with at least one other recess which serves as an engagement face for a complementary building element, the building element being kept in position by its own weight owing to the action of gravity. The building element here serves e.g. as a roll-on ramp to the playing surface formed by the sides of the trunk.

BRIEF DESCRIPTION OF THE DRAWINGS

The invention will be explained more fully below in connection with a preferred embodiment and with reference to the drawing, in which.

DETAILED DESCRIPTION OF THE PREFERRED EMBODIMENT

Figure 1:
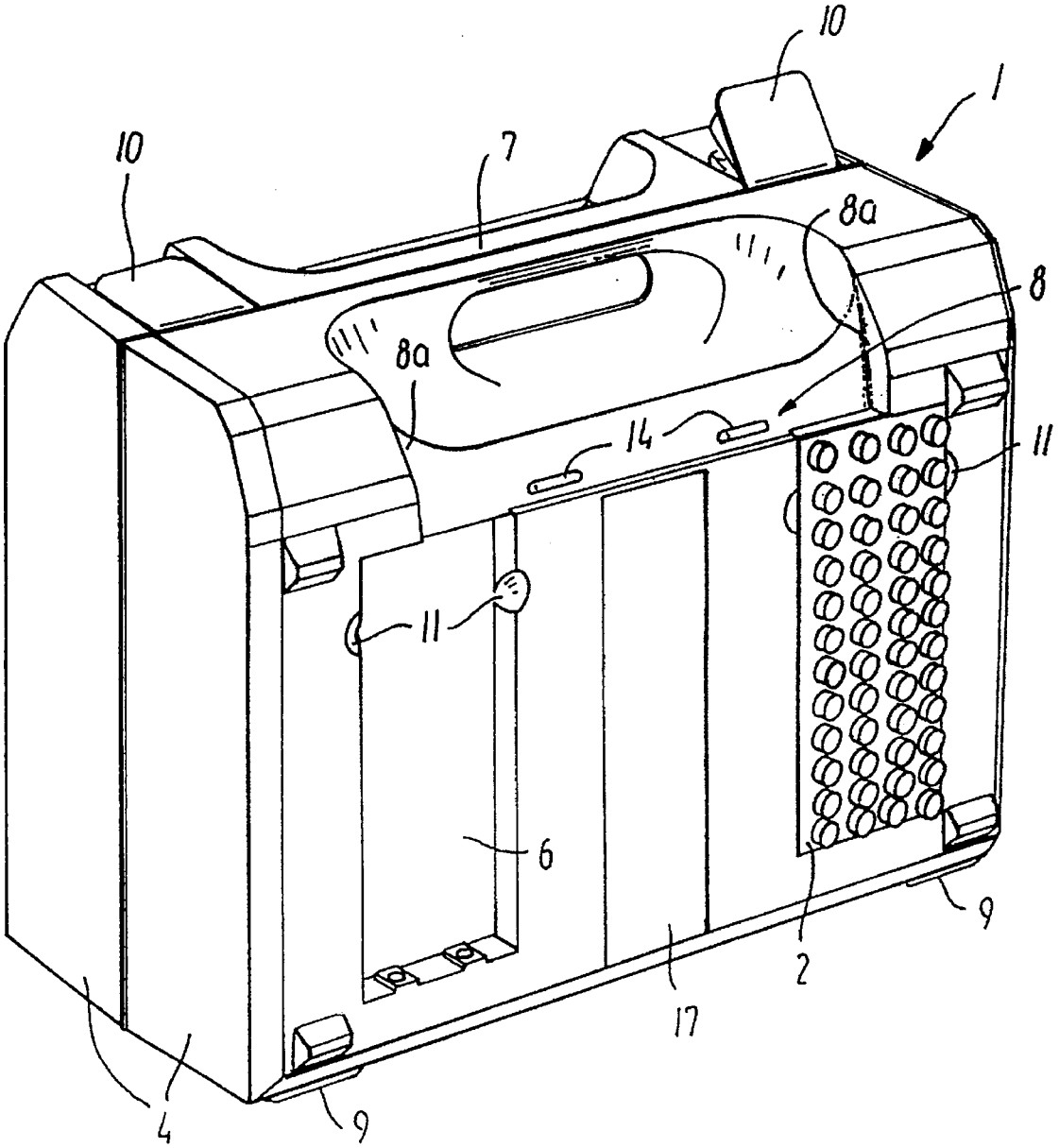
FIG. 1 is a perspective view of a preferred embodiment of a trunk according to the invention.
Figure 2:
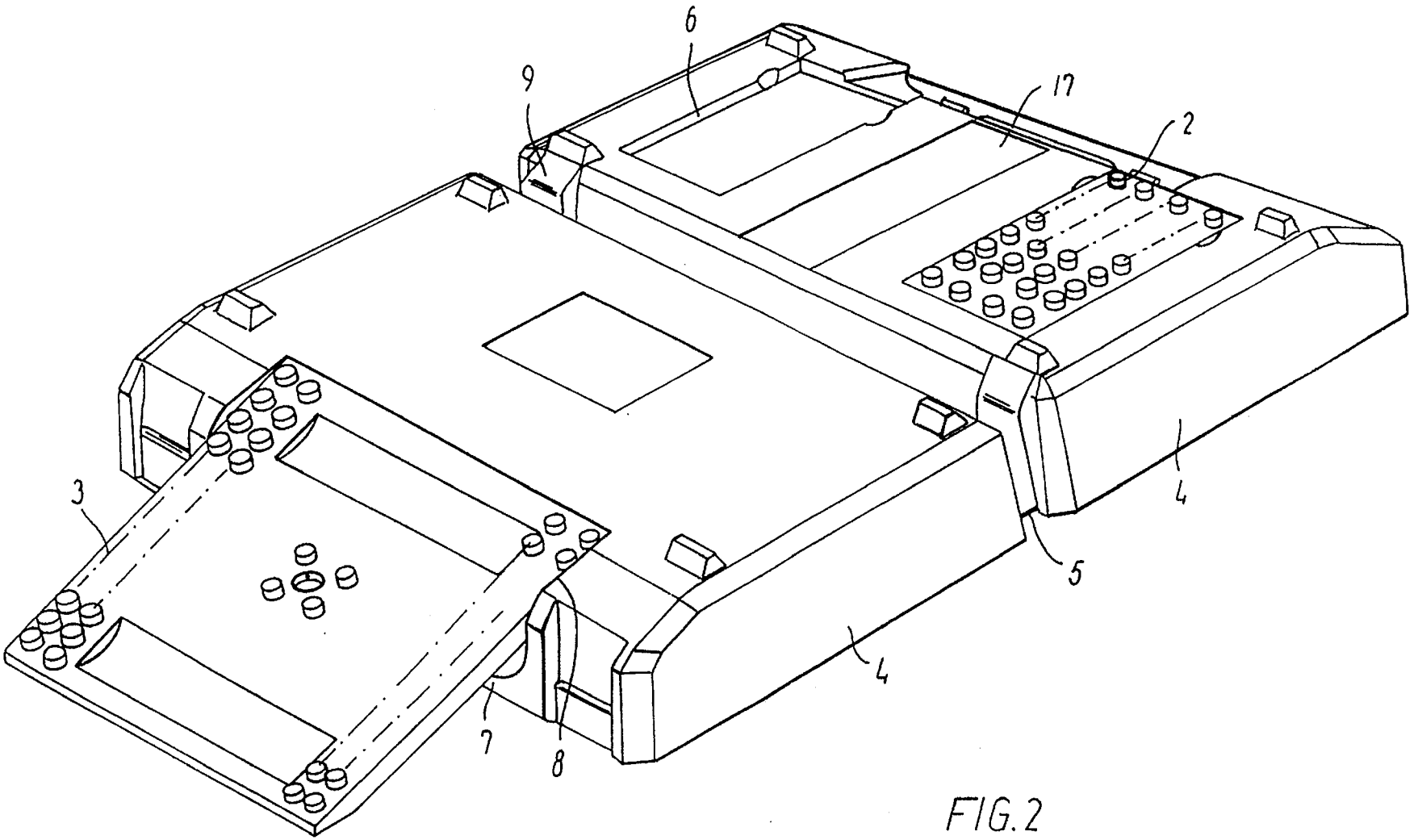
FIG. 2 is a perspective view of the trunk shown in FIG. 1 in an open position with mounted plate elements.

FIG. 1 shows a receptacle for the storage of building elements (not shown) for a constructional building set, e.g. elements available under the trade marks DUPLO® or TOOLO®, constructed as a trunk 1 having hinged parts 4. The receptacle is formed with one or more recesses 6 or 8 to receive plate-shaped elements 2, 3 of the constructional building set (the ramp 3 is shown in FIG. 2). Coupling portions in the form of locking projections 12, 14 (see FIGS. 3 and 4) are provided along at least a portion of these recesses 6 and 8 to cooperate with complementary coupling portions in the form of grooves 13, 16 with a view to establishing temporary or releasable retention of the plate-shaped elements 2, 3.

The trunk 1, which is shown in a closed position in FIG. 1, consists of two hinged parts 4 which are interconnected via an integral hinge 5. The trunk 1 is made by blow moulding of a preform with simultaneous vacuum forming of selected, information-carrying areas 17. The parts of the trunk move about the integral hinge 5 and are locked in the closed position by means of integrally hinged locking plates 10 which extend over complementary locking projections on the other part of the trunk, whereby closing of the locking plates 10 establishes a pull in their longitudinal direction so that the trunk is kept securely closed.

The trunk is moreover formed with a handle 7 which makes it easy to transport. Interiorly, the trunk is divided into compartments so that the constructional building set may be stored safely. Further, the trunk, which is double-walled, is interiorly provided with recesses for tool parts incorporated in the constructional building set. This is not shown. Exteriorly, the trunk is formed with recesses 6 to receive plate elements 2, which will be explained later. The plate elements 2 are preferably removed from the trunk surface during transport, since the plate elements 2 are made of a more fragile material, while the material of the trunk itself is selected with a view to resisting the impacts that occur during transport. Since the plate elements 2 are received in the recesses so that the element surface is substantially flush with the trunk surface, finger grooves 11 are provided in connection with the recesses so that it is easy to remove the plate elements when play is over.

The trunk is shown in a play position in FIG. 2, it being opened about the integral hinge 5. It will be seen that the bottom of the trunk is formed with legs 9 whose height is selected such that the legs serve as a stop when the trunk is opened. The two side faces of the trunk hereby define a working or playing surface which is substantially plane.

Figure 3:
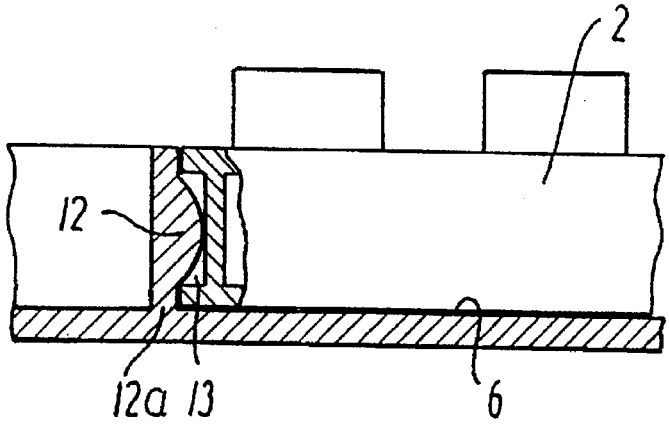
FIG. 3 is a view of an embodiment of the coupling portions of the recesses on the trunk shown in FIGS. 1 and 2.

It will likewise be seen that a plate element 3 in the form of a ramp is mounted in the recess 8 in the area around the handle 7. Vehicles can hereby drive up on to a working face formed by the trunk sides, and the trunk itself can be used as a base for the erection of e.g. a crane, since, in this case, the plate elements serve as a base or foundation. FIG. 3 shows the coupling portions at one end of the recess 6, and these are formed by ball portions 12 arranged on an elevation 12*a*. These ball portions extend into the locking groove 13, which may e.g. have the shape of cylinder parts. If the plate element 2 has a size corresponding to 4×12 modular measures for the building system in question, sufficient retention can be obtained by using two mating locking projections/grooves 12, 13 at each end of the recess at a mutual distance of two modular measures.

Figure 4:
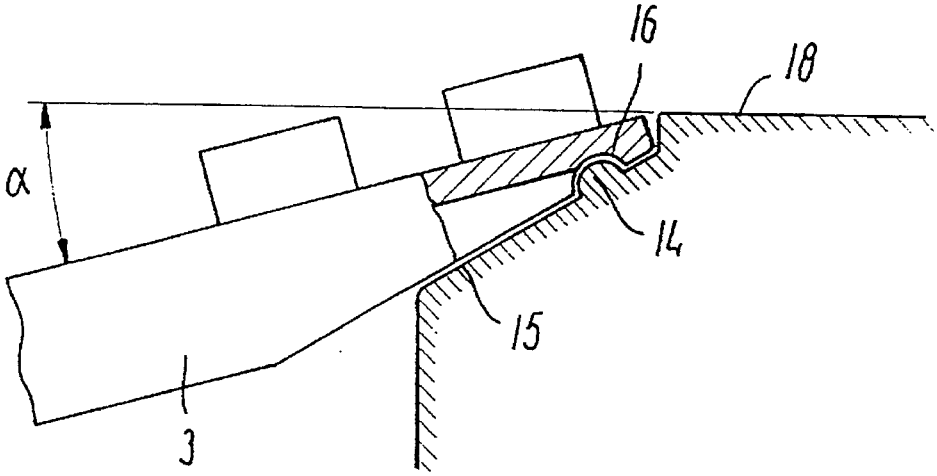
FIG. 4 is a view of a second embodiment of the coupling portions of the recesses on the trunk shown in FIGS. 1 and 2.

It is shown in FIG. 4 how the ramp 3 is retained with respect to the trunk 1. The ramp 3 is formed with a transverse groove 16 at each end, which is adapted to receive complementary beads 14 on the outer side of the trunk. Around the handle 7, the trunk is formed with engagement faces 15 on which the ramp 3 rests. The other end of the ramp rests on the base on which the trunk 1 is positioned. A vehicle built from the building elements of the constructional building set can hereby drive via the ramp 3 to the upper side of the trunk 1. The engagement between the groove 16 and the bead or the locking projection 14 ensures that the ramp 3 is retained by its weight. Thus, there is no displacement between the ramp 3 and the trunk 1. If needed, the side walls 8*a* in the recess 8 may likewise be formed with locking projections corresponding to the locking projections 12*a*, and the ramp 3 may be formed with locking grooves corresponding to the locking grooves 13 in the plate element 2. One end of the ramp 3 can hereby be retained by snap coupling in the recess 8.

It will be seen from FIG. 4 that the ramp 3 forms an angle $\alpha$ with the upper side of the trunk, which is indicated by the reference numeral 18, said angle being preferably between 10° and 40°.

We claim:

1. In combination, a receptacle in the form of a trunk for the storage of building elements for a constructional building set and at least one plate-shaped building element incorporated in said constructional building set, said receptacle including side faces and a handle, said receptacle being formed of portions hinged to one another and having a surface formed with a first recess to receive therein said plate-shaped building element, complementary retention means in the form of projections and grooves provided along a portion of a periphery of said first recess and on said plate-shaped building element, said projections and grooves cooperating to establish a temporary retention of said plate-shaped building element in said recess, said surface of said receptacle and said plate-shaped building element being formed so that when said plate-shaped building element is retained in said recess, said surface and an outer surface of said plate-shaped building element are substantially aligned at the same level, said receptacle being provided with a second recess in the area around said handle, said second recess consisting of an end wall having two side walls which extend at right angles thereto and between which said plate-shaped building element can be retained, said end wall forming an engagement face on which said plate-shaped building element can rest, said end wall forming an angle of between 10° and 40° with one of the side faces of said receptacle, projections being provided at said end wall on which the plate-shaped building element having complementary grooves is retained through its weight.

2. The invention according to claim 1, wherein said receptacle is made of plastic and has portions interconnected through an integral hinge.

3. The invention according to claim 2, wherein said receptacle has feet along the integral hinge, said feet defining an end stop when said receptacle is opened so that the side faces of said receptacle define a substantially plane working surface.

4. The invention according to claim 1, wherein said first recess is provided at a side face of said receptacle in the form of a rectangular depression provided with projections at two opposed side walls thereof for snap coupling with complementary grooves provided at two opposed side walls of said plate-shaped building element.

* * * * *